US009046257B2

(12) United States Patent
Burguburu

(10) Patent No.: US 9,046,257 B2
(45) Date of Patent: Jun. 2, 2015

(54) LIGHTING DEVICE

(75) Inventor: Sebastien Burguburu, Elndhoven (NL)

(73) Assignee: Koninklijkle Philips N.V., Eindhoven (NL)

( * ) Notice: Subject to any disclaimer, the term of this patent is extended or adjusted under 35 U.S.C. 154(b) by 364 days.

(21) Appl. No.: 13/496,888

(22) PCT Filed: Sep. 9, 2010

(86) PCT No.: PCT/IB2010/054060

§ 371 (c)(1),
(2), (4) Date: Mar. 19, 2012

(87) PCT Pub. No.: WO2011/036592

PCT Pub. Date: Mar. 31, 2011

(65) Prior Publication Data

US 2012/0176799 A1 Jul. 12, 2012

(30) Foreign Application Priority Data

Sep. 22, 2009 (EP) ..... 09305883

(51) Int. Cl.

| | |
|---|---|
| ***F21V 17/02*** | (2006.01) |
| ***F21V 21/00*** | (2006.01) |
| ***F21S 8/06*** | (2006.01) |
| ***F21V 21/14*** | (2006.01) |
| ***F21S 8/02*** | (2006.01) |

(Continued)

(52) U.S. Cl.

CPC ..... *F21V 21/14* (2013.01); *F21S 8/026* (2013.01); *F21V 14/04* (2013.01); *F21V 21/096* (2013.01)

(58) Field of Classification Search

CPC . F21V 21/096; F21V 21/0965; F21V 17/105; F21S 8/02

USPC ..... 362/398, 364–366, 404, 147–150

See application file for complete search history.

(56) References Cited

U.S. PATENT DOCUMENTS

| | | | | |
|---|---|---|---|---|
| 3,468,576 | A | 9/1969 | Beyer et al. | |
| 6,405,986 | B1 | 6/2002 | Swadling | |
| 7,399,104 | B2 * | 7/2008 | Rappaport | 362/365 |

(Continued)

FOREIGN PATENT DOCUMENTS

| | | | |
|---|---|---|---|
| DE | 202008005048 | U1 | 4/2008 |
| WO | 03036159 | A1 | 5/2003 |

(Continued)

*Primary Examiner* — Jong-Suk (James) Lee
*Assistant Examiner* — Alexander Garlen
(74) *Attorney, Agent, or Firm* — Meenakshy Chakravorty

(57) ABSTRACT

A lighting device providing an easy installation in a roof or a wall, having a small number of pieces is disclosed. The lighting device comprises at least a holding body (1) having a main axis (A) and at least one opening (4), comprising at least one magnetic band called "fixed band" (5) including at least one first magnetic element having a first polarity, and body (6) arranged to hold at least one light source, said light body being capable of moving with respect to the holding body relative at least to the main axis, comprising at least one magnetic band called "mobile band" including at least one second magnetic element having a second polarity opposite the first polarity, wherein said mobile band faces at least a part of the fixed band during at least a part of the motion of the light body with respect to the holding body. The magnetic strength between the at least one first magnetic element and the at least one second magnetic element is sufficient to hold the light body relative to the holding body, when the first magnetic element faces the second magnetic element.

15 Claims, 4 Drawing Sheets

(51) Int. Cl.
*F21V 21/096* (2006.01)
*F21V 14/04* (2006.01)

(56) References Cited

U.S. PATENT DOCUMENTS

| | | | | |
|---|---|---|---|---|
| 7,824,083 | B2 * | 11/2010 | Fullerton et al. | 362/398 |
| 8,651,711 | B2 * | 2/2014 | Rudisill et al. | 362/398 |
| 2005/0184207 | A1 * | 8/2005 | Bertram, III | 248/229.1 |
| 2006/0221620 | A1 * | 10/2006 | Thomas | 362/364 |
| 2009/0067165 | A1 * | 3/2009 | Sanoner et al. | 362/191 |
| 2009/0086478 | A1 * | 4/2009 | Sanroma et al. | 362/234 |
| 2009/0251250 | A1 * | 10/2009 | Tait et al. | 335/285 |
| 2010/0197148 | A1 * | 8/2010 | Rudisill et al. | 439/40 |
| 2011/0121145 | A1 * | 5/2011 | Mihajlovic | 248/188 |

FOREIGN PATENT DOCUMENTS

| | | | |
|---|---|---|---|
| WO | 2007138521 | A2 | 12/2007 |
| WO | 2007145446 | A2 | 12/2007 |

* cited by examiner

LIGHTING DEVICE

FIELD OF THE INVENTION

The invention relates in general to lighting device and more particularly to a lighting device providing an easy installation in a roof or a wall, having a small number of pieces.

BACKGROUND OF THE INVENTION

It is well known that lighting device usually comprises a holding body inside which one or more light sources are housed. The holding body has an opening through which access to the light sources is allowed and through which the light beam emitted by the light sources spreads externally out of the container, so that the surrounding atmosphere is illuminated.

Accessorily, the opening in the holding body is closed by a cover that is transparent to the light and is usually made of glass or plastic material, to avoid external foreign bodies entering the holding body and impairing operation of the light sources.

Positioning of such a recessed luminary fixed in a roof or in a wall is usually obtained by mechanical systems and the blocking of this recessed luminary is done by screwing, teeth or spring.

Recessed luminary of prior art comprises a large number of pieces and is cumbersome and its installation is very often hard and time consuming.

To overcome above-mentioned limitation, a need exists for a compact lighting device providing an easy installation in a roof or a wall, having a small number of pieces.

SUMMARY OF THE INVENTION

It is therefore an object of the invention to provide lighting device comprising at least a holding body having a main axis and at least one opening, comprising at least one magnetic band called "fixed band" including at least one magnetic element or pole having a first polarity, a light body arranged to hold at least one light source, said light body being capable of moving with respect to the holding body relative at least to the main axis, comprising at least one magnetic band called "mobile band" including at least one magnetic element or pole having a second polarity opposite the first polarity, said mobile band extending in front of the fixed band, wherein the magnetic strength between at least one pole of the fixed band and at least one opposite pole of the mobile band is sufficient to hold the light body relative to the holding body.

The fixed magnetic band(s) may be comprised in or on at least one inner wall or outer wall of the holding body. The fixed magnetic band(s) may be comprised in or on at least one inner wall or outer wall of the light body.

The lighting device may be arranged such that the light body moves either around or into the holding body. In the first case, the holding body looks like a post and in the second case as a housing. In both cases, the light body is advantageously guided, by the outer wall ($1^{st}$ case) or the inner wall ($2^{nd}$ case) of the holding body.

Two opposite inner walls of the holding body comprise a fixed band and two opposite outer walls of the light body comprise a mobile band.

Preferably, the fixed band comprises a plurality of positive and negative poles alternatively positioned along the main axis.

According to different embodiments, in the one hand the mobile band can comprise one magnetic pole or one positive magnetic pole and one negative magnetic pole alternatively positioned along the main axis or a plurality of positive and negative poles alternatively positioned along the main axis, and in the other hand the fixed band can comprise one magnetic pole or one positive magnetic pole and one negative magnetic pole alternatively positioned along the main axis.

Advantageously, the fixed and/or mobile band is a flexible strip and the fixed band and the mobile band are bound onto the inner wall of the holding body and respectively onto the outer wall of the light body.

Each magnetic pole is a ferrite permanent magnet for instance.

The light body further comprises a reflector which is pivotally mounted on the bottom part of the light body.

BRIEF DESCRIPTION OF THE DRAWINGS

For a further understanding of the objects and advantages of the present invention, references should be made to the following drawings in conjunction with the accompanying descriptions and operations, wherein.

DETAILED DESCRIPTION OF EMBODIMENTS

Figure 1:
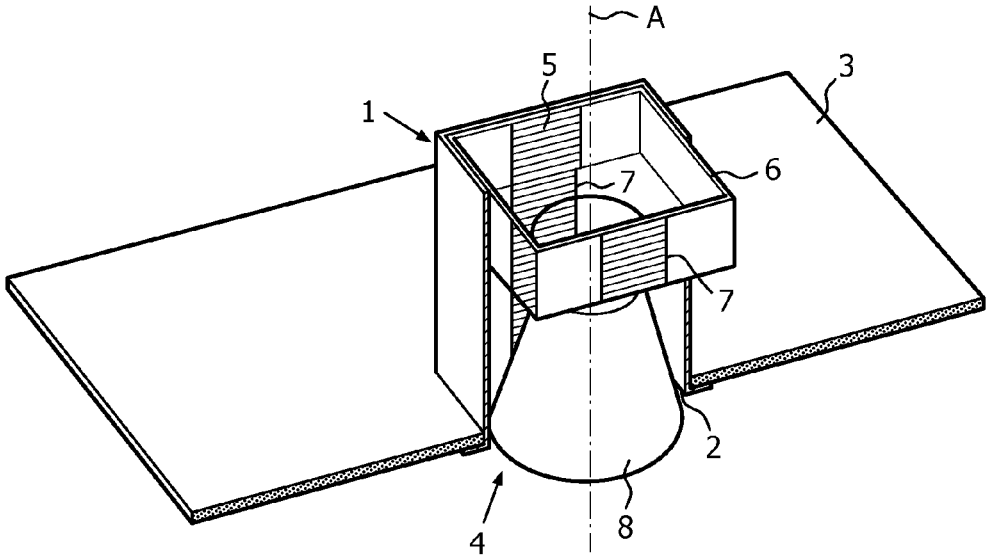
FIG. 1 shows a schematic cutaway perspective view of the lighting device according to the present invention.
Figure 2:
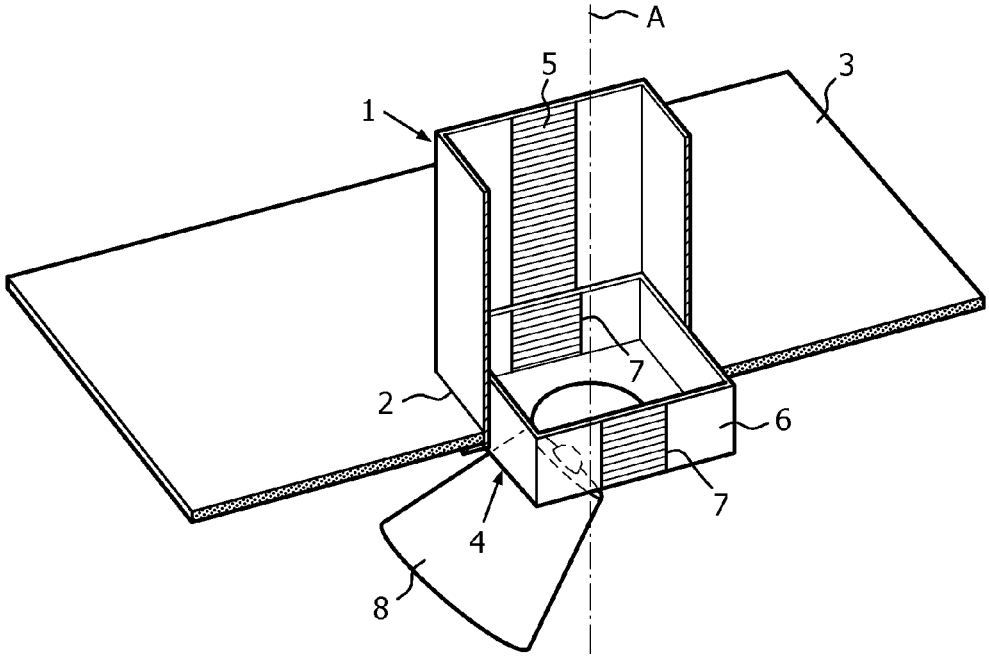
FIG. 2 shows a schematic cutaway perspective view of the lighting device according to the present invention in an opened position.

It is emphasized that, in accordance with the standard practice in the industry, various features are not drawn to scale. In fact, the dimensions of the various features may be arbitrarily increased or reduced for clarity of discussion.

For the purpose of promoting an understanding of the present invention, references are made in the text hereof to embodiments of lighting device, only some of which are depicted in the drawings. It is nevertheless understood that no limitations to the scope of the invention are thereby intended.

Furthermore, in the embodiments depicted, like reference numerals refer to identical structural elements in the various drawings.

Referring to FIG. 1, the lighting device according to the invention comprises a holding body 1 having a squared cross section and a vertical main axis A. Said holding body 1 is embedded in a squared hole 2 formed in a roof 3 and comprises an opening 4 in its bottom part. Two opposite inner wall of the holding body 1 comprises one magnetic band called fixed band 5. Each fixed band 5 comprises a plurality of positive 5*a* and negative 5*b* poles alternatively positioned along the main axis A. Said fixed band 5 is preferably a flexible strip which is bound onto the inner wall of the holding body 1. Each magnetic pole is a ceramic or ferrite permanent magnet.

Alternatively, the fixed band 5 can be injection molded magnets without departing from the scope of the invention. Injection molded magnets are a composite of various types of resin and magnetic powders, allowing parts of complex shapes to be manufactured by injection molding, flexible magnets being similar to injection molded magnets, using a flexible resin or binder such as vinyl, and produced in flat strips, shapes or sheets.

Moreover, the lighting device comprises a light body 6 holding at least one light source, not shown on figures, said light body having a squared cross section and being capable of moving into the holding body 1 relative along the main axis A. Secondarily, the light body 6 comprises a reflector 8 which is preferably pivotally mounted on the bottom part of the light body. Two opposite outer wall of the light body 6 comprises a magnetic band called mobile band 7 extending in front of each fixed band 5. Each mobile band 7 comprises a plurality of positive 7*a* and negative 7*b* poles alternatively positioned along the main axis A. Said mobile band 7 is preferably a flexible strip which is bound onto the outer wall of the light body 1 and each magnetic pole is a ceramic or ferrite permanent magnet. In the same manner than the fixed band 5, the mobile band 7 can be injection molded magnets without departing from the scope of the invention.

The magnetic strength between each positive 5*a* and negative 5*b* poles of the fixed band and each negative 7*b* and positive 7*a* poles of the mobile band 7 is in the order of few mT which is sufficient to hold the light body into the holding body and to allow the moving of the light body in the holding body by hand. It should be noted that the magnetic strength will therefore depend on the size and the weight of the light body notably. The man skilled in the art will easily adapt the magnetic strength to the size and the weight of the light body.

Alternatively, the holding body 1 and the light body 6 can comprise only one fixed band 5 and respectively one mobile band 7 extending in front of said fixed band 5. Moreover, the fixed band 5 and/or the mobile band 7 can comprise only one magnetic pole, the mobile band 7 comprising a magnetic pole opposite to the magnetic pole of the fixed band 5, and/or one positive magnetic pole and one negative magnetic pole alternatively positioned along the main axis and respectively one negative magnetic pole and one positive magnetic pole alternatively positioned along the main axis.

Figure 6A:
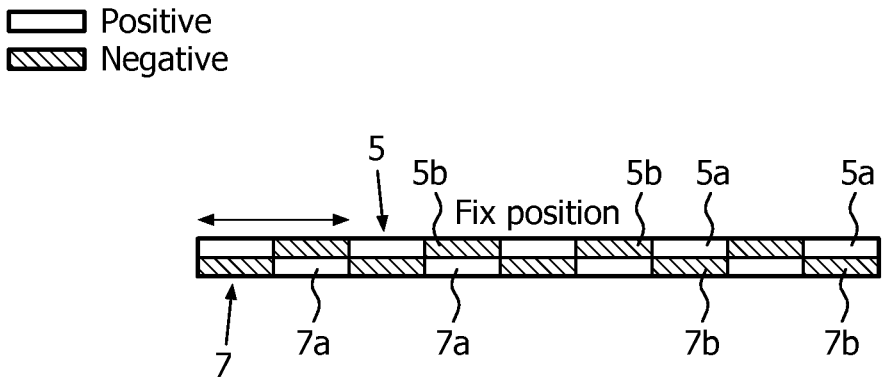
FIGS. 6A to 6F show a schematic representation of the different positions of the mobile band relative to the fixed band during the opening of the lighting device according to the invention.
Figure 6B:
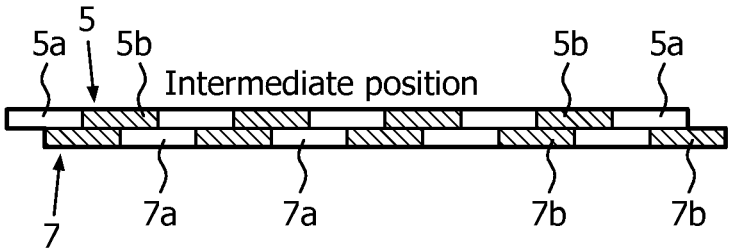
Figure 6C:
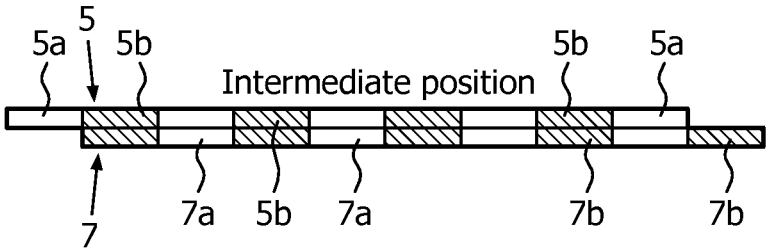
Figure 6D:
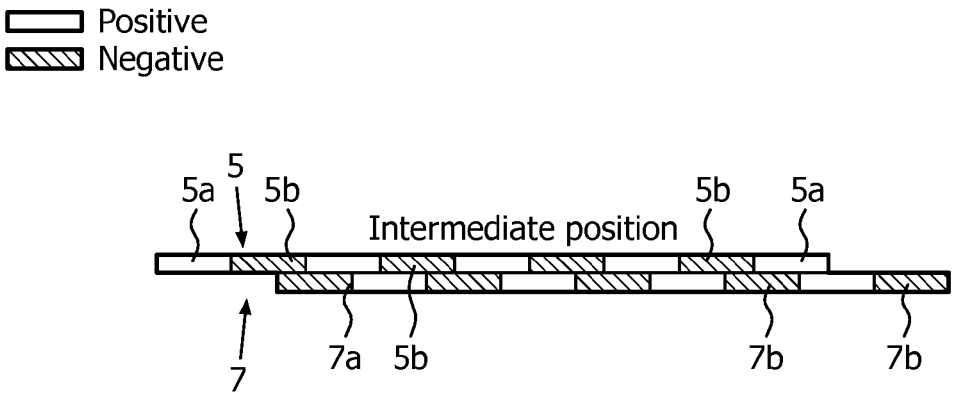
Figure 6E:
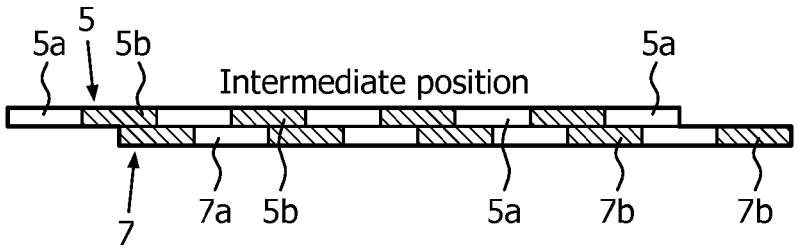
Figure 6F:
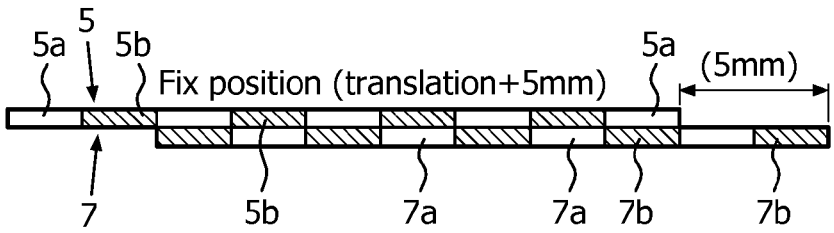

When the light body 6 is in its retracted state, referring to FIGS. 1 and 6A, each positive pole 5*a* and negative pole 5*b* of the fixed band 5 extend in front of each negative 7*b* and respectively positive pole 7*a* of the mobile band 7. The magnetic strength between each positive 5*a* and negative 5*b* poles of the fixed band 5 and each negative 7*b* and positive 7*a* poles of the mobile band 7 is sufficient to hold the light body 6 into the holding body 1 by compensating the gravity effect. When the light source must be changed for instance, the light body 6 is manually slid downward (FIGS. 2 and 6B to 6F) until each positive 5*a* and negative poles 5*b* of the fixed band 5 extend in front of each negative 7*b* and respectively positive pole 7*a* of the mobile band 7. It should be noted that, in this particular embodiment, each positive 5*a*,7*a* and negative poles 5*b*,7*b* of the fixed band 5 and respectively mobile band 7 present a height of about 5 mm in such a manner that the light body 6 can be moved with a 5 mm pitch.

Figure 3:
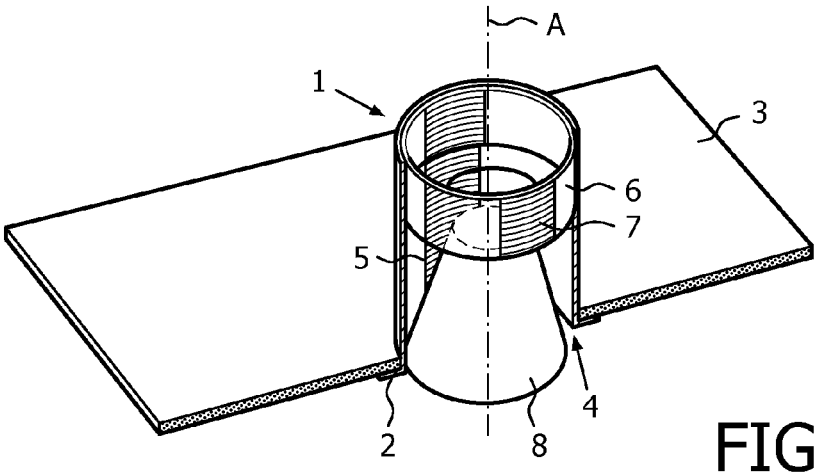
FIG. 3 shows a schematic cutaway perspective view of another embodiment of the lighting device according to the present invention.
Figure 4:
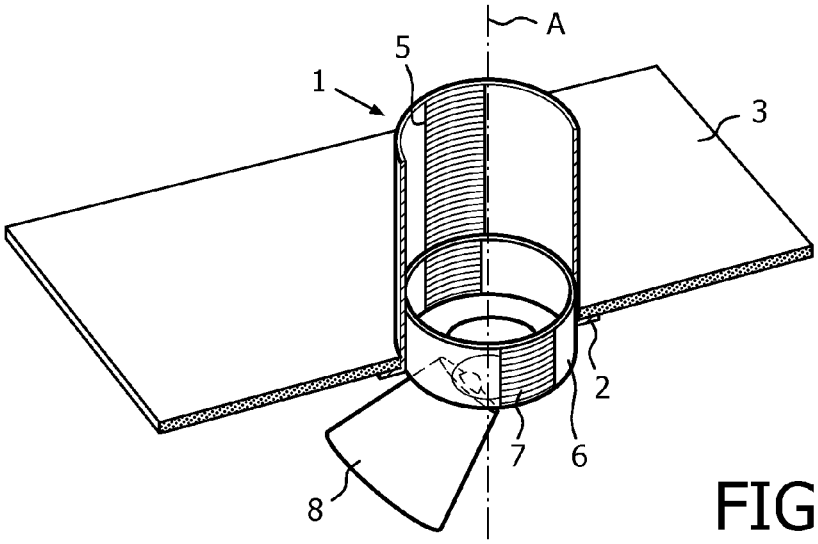
FIG. 4 shows a schematic cutaway perspective view of the embodiment of the lighting device according to the present invention illustrated in FIG. 3 in an opened position.
Figure 5:
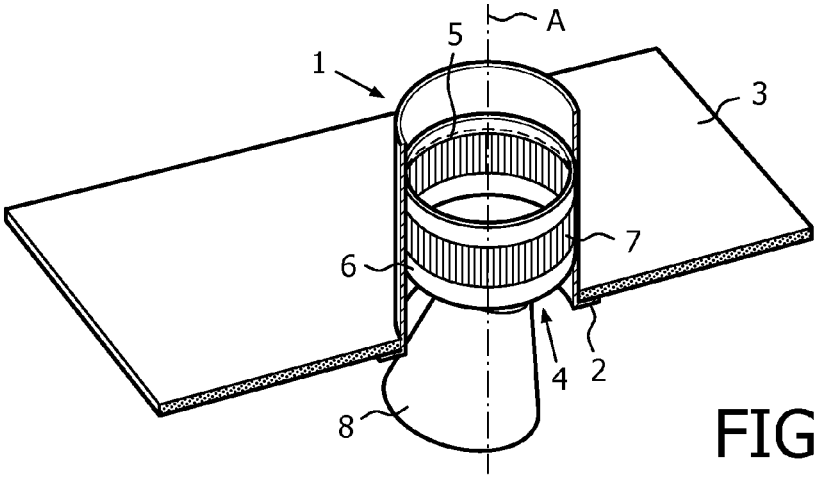
FIG. 5 shows a schematic cutaway perspective view of a third embodiment of the lighting device according to the present invention

In another embodiment, referring to FIGS. 3 and 4, the holding body 1 and the light body 6 have a cylindrical shape. In this embodiment, the fixed box-shape body 1 embedded in a circular hole 2 formed in a roof 3 comprises two magnetic band called fixed band 5 bounded onto the inner wall and diametrically opposed. Each fixed band 5 comprises a plurality of positive 5*a* and negative 5*b* poles alternatively positioned along the main axis A of the holding body, the main axis corresponding to the revolution axis of said holding body 1. Said fixed bands 5 are preferably flexible strips which are bound onto the inner wall of the holding body 1. Moreover, the light body 6 comprises also two magnetic bands called mobile bands 7 bounded onto the outer wall and diametrically opposed, said mobile bands 7 extending in front of fixed bands 5. Each mobile band 7 comprises a plurality of positive 7*a* and negative 7*b* poles alternatively positioned along the main axis A In yet another embodiment, referring to FIG. 5, the holding body 1 and the light body 6 have a cylindrical shape. In this embodiment, the holding body 1 embedded in a circular hole 2 formed in a roof 3 comprises one magnetic band called fixed band 5 bounded onto the inner wall. Said fixed band 5 comprises a plurality of positive 5*a* and negative 5*b* poles alternatively positioned around the main axis A of the holding body 1, the main axis corresponding to the revolution axis of said holding body 1. Moreover, the light body 6 comprises also one magnetic band called mobile band 7 bounded onto the outer wall and extending around the main axis A in front of fixed band 5. Said mobile band 7 comprises a plurality of positive 7*a* and negative 7*b* poles alternatively positioned around the main axis A. In this way, a user can manually rotate the light body around the main axis A.

Although embodiments of the present disclosure have been described in detail, those skilled in the art should understand that they may make various changes, substitutions and alterations herein without departing from the spirit and scope of the present disclosure. For instance, the light body 6 can extends outward from the holding body 1, i.e. the light body 6 surrounds the holding body without departing from the scope of the invention. Moreover, the fixed band 5 and/or the mobile band 7 can be embedded in the walls of the holding body 1 and respectively the light body 6 and the mobile band can face only a part of the fixed band during at least a part of the motion of the light body with respect to the holding body.

Accordingly, all such changes, substitutions and alterations are intended to be included within the scope of the present disclosure as defined in the following claims.

The invention claimed is:

1. A lighting device comprising:

a holding body having a main axis and comprising at least one first magnetic band including at least one first magnetic element having a first polarity, a light body arranged to hold at least one light source, the light body being mountable to a plurality of positions with respect to the holding body relative at least to the main axis and comprising at least one second magnetic band including at least one second magnetic element having a second polarity opposite the first polarity, wherein the second band faces at least a part of the first during at least a part of the motion of the light body with respect to the holding body, wherein the magnetic strength between the at least one first magnetic element and the at least one second magnetic element is sufficient to held retain the light body relative to the holding body, when the first magnetic element faces the second magnetic element.

2. Lighting device of claim 1, wherein the light body extends into the holding body.

3. Lighting device of claim 1, wherein the light body surrounds the holding body.

4. Lighting device of claim 2, wherein one or two opposite inner walls of the holding body comprise(s) the first band and one or two opposite outer walls of the light body comprise(s) the second band.

5. Lighting device of claim 1, wherein the first band comprises a plurality of magnetic elements having positive and negative poles alternatively positioned along the main axis.

6. Lighting device of claim 5 wherein the second band comprises one magnetic element.

7. Lighting device of claim 5, wherein the second band comprises one positive magnetic element having a negative polarity and one negative magnetic element having a positive polarity, alternatively, to be positioned parallel the main axis.

8. Lighting device of claim 1, wherein the second band comprises a plurality of positive and negative magnetic elements alternatively positioned parallel the main axis.

9. Lighting device of claim 8, wherein the first comprises one magnetic element.

10. Lighting device of claim 8, wherein the first band comprises one positive magnetic element and one negative magnetic element alternatively positioned along the main axis.

11. Lighting device of claim 1, wherein the first and/or second band is a flexible strip.

12. Lighting device of claim 1, wherein the first band and the second band are bound onto the inner wall of the holding body and respectively onto the outer wall of the light body.

13. Lighting device of claim 1, wherein each magnetic element is a ferrite permanent magnet.

14. Lighting device of claim 1, wherein the light body further comprises a reflector.

15. Lighting device of claim 14, wherein the reflector is pivotally mounted on the bottom part of the light body.

* * * * *